US006888129B2

(12) United States Patent
Bowdler et al.

(10) Patent No.: US 6,888,129 B2
(45) Date of Patent: May 3, 2005

(54) ION OPTICS SYSTEM FOR TOF MASS SPECTROMETER

(75) Inventors: Andrew R. Bowdler, Walsall (GB); Emmanuel Raptakis, Bramhall (GB)

(73) Assignee: Kratos Analytical Limited, Manchester (GB)

( * ) Notice: Subject to any disclaimer, the term of this patent is extended or adjusted under 35 U.S.C. 154(b) by 93 days.

(21) Appl. No.: 09/946,823

(22) Filed: Sep. 6, 2001

(65) Prior Publication Data

US 2002/0036262 A1 Mar. 28, 2002

(30) Foreign Application Priority Data

Sep. 6, 2000 (GB) ..... 0021902

(51) Int. Cl.[7] ..... H01J 49/40; H01J 49/16
(52) U.S. Cl. ..... 250/287; 250/288; 250/423 P
(58) Field of Search ..... 250/287, 288, 250/423 P

(56) References Cited

U.S. PATENT DOCUMENTS

| | | | | |
|---|---|---|---|---|
| 3,644,731 A | * | 2/1972 | Eloy | 250/288 |
| 4,204,117 A | * | 5/1980 | Aberle et al. | 250/287 |
| 4,740,696 A | | 4/1988 | Osawa et al. | |
| 4,904,872 A | | 2/1990 | Grix et al. | |
| 4,973,842 A | * | 11/1990 | Gruen et al. | 250/309 |
| 5,118,937 A | * | 6/1992 | Hillenkamp et al. | 250/282 |
| 5,496,988 A | | 3/1996 | Saile | |
| 5,496,998 A | | 3/1996 | Bergmann | |
| 5,614,711 A | * | 3/1997 | Li et al. | 250/338.3 |
| 5,742,049 A | | 4/1998 | Holle et al. | 250/282 |
| 5,777,325 A | * | 7/1998 | Weinberger et al. | 250/287 |
| 5,965,884 A | * | 10/1999 | Laiko et al. | 250/288 |
| 6,075,243 A | | 6/2000 | Nabeshima et al. | |
| 6,444,980 B1 | * | 9/2002 | Kawato et al. | 250/307 |

FOREIGN PATENT DOCUMENTS

| | | |
|---|---|---|
| EP | 0692713 A1 | 1/1996 |
| GB | 2301703 A | 12/1996 |
| JP | 08-069770 | 3/1996 |
| WO | WO 99/53521 | 10/1999 |

* cited by examiner

*Primary Examiner*—Jack I. Berman
(74) *Attorney, Agent, or Firm*—Squire, Sanders & Dempsey L.L.P.

(57) ABSTRACT

A time of flight (TOF) mass spectrometer includes an ion source which has an extraction lens. The extraction lens has an element with an aperture. The aperture extends through the element to form a through-channel. In use, ions may pass from one side of the element to the opposite side of the element by passing through the through channel. The through channel has a length which is equal to or greater than 8/10 of a diameter of the aperture.

22 Claims, 3 Drawing Sheets

ION OPTICS SYSTEM FOR TOF MASS SPECTROMETER

This invention relates to an ion optics system for a time of flight (TOF) mass spectrometer. In particular, this invention relates to an extraction lens and a light reflecting system for a TOF mass spectrometer. The invention is applicable to both linear and reflectron TOF mass spectrometers.

A time of flight mass spectrometer traditionally comprises three separate regions; an extraction region and an acceleration region (which together make up the ion source) and a drift region. These regions are shown in the prior art FIG. 1.

As shown in FIG. 1, the extraction region, 1, is typically enclosed by two charged plates. The first plate, 4, which may be the sample plate in a Maldi (matrix assisted laser desorption ionisation) TOF spectrometer, is charged to repel ions towards the accelerating electrode, 5, which is provided with a grid or aperture, 6, through which the ions may pass into the acceleration region, 2.

As can be seen, the acceleration region is enclosed by the accelerating electrode, 5, on one side and a gridded or apertured ground plate, 7, on the other side. The accelerating electrode, 5, is provided with an accelerating voltage to accelerate ions towards the ground plate, 7. The ground plate is at ground potential and the ions pass through this plate, 7, into the drift region, 3, of the mass spectrometer. Within the drift region, the accelerated ions become separated according to their velocity and mass to charge ratio and therefore reach a detector, 8, positioned at the end of the drift region at different times. Measurement of the time taken to traverse the drift region is then used to derive the mass to charge ratio.

The plates/electrodes used in the extraction and acceleration regions are simply planar sheets with a central aperture or gridded region. The aperture in the accelerating electrode, 5, is usually fairly small because once the size is increased beyond, say 2 mm, the field created by the potential difference between the sample plate 4 and the ground plate 7 electrode extends into the region immediately in front of the sample plate, 4, and this can result in ions being extracted at an undesired time and/or having an undesired trajectory. Therefore, it is necessary to maintain a small aperture. Small apertures quickly become contaminated by material sputtered from the sample and therefore it is necessary to clean the electrode regularly.

Additionally, it is desirable to be able to direct a laser light beam into the ion source to allow Maldi ionisation of the sample on the sample plate, 4. It is known to provide a one-piece stainless steel reflector to reflect light into the ion source but this reflector is difficult to manufacture and needs to be removed in its entirety for maintenance or cleaning.

The following invention aims to ameliorate some or all of the above problems.

Accordingly, in a first aspect there is provided an extraction lens for a TOF mass spectrometer ion source, said lens including an element having an aperture, said aperture extending through the element so as to form a through channel, such that, in use, ions may pass from one side of the element to the opposite side of the element by passing through said through channel; characterised in that said through channel has a length equal to or greater than 8/10 of the diameter of said aperture.

This provides an extraction lens which leads to improved extraction and spatial focussing of ions.

In addition, as the length of the through channel formed by the aperture is at least equal to 8/10 of its diameter, field penetration through the extraction lens aperture into the region in front of the sample plate is kept at a low level and ions are not prematurely extracted. The aperture can thus be made larger than would otherwise be possible. A larger aperture is advantageous because compared to a smaller aperture, it does not become quickly contaminated with material sputtered from the sample. It is also easier to direct a laser or other light source through a larger aperture. This is useful when it is desired to direct a light beam onto the sample plate, along a path at a small angle to or substantially coincident with the spectrometer's ion-optical axis.

More preferably the length of the through channel is equal to or greater than 9/10 of the diameter of the aperture. More preferably still the length of the through channel is equal to or greater than the diameter of the aperture. This reduces field penetration still further.

As will be appreciated from the above it is important that the length of the through channel is equal to or greater than 8/10 of the diameter of the aperture. This can be achieved, for example, by use of a thick planar element having an aperture extending therethrough, the thickness of the element being at least equal to if not greater than 8/10 of the diameter of said aperture.

Preferably however the through channel is formed at least partly by a hollow, elongated member upstanding from the surface of the element having said aperture. The hollow, elongated member and the aperture extending through said element together form a through channel having a length equal to or greater than 8/10 of the diameter of said aperture. This has the advantage that the upstanding, hollow, elongated member upstanding from the surface of the element provides a good field shape for focusing the ion beam.

In preferred embodiments, the element is a planar element. Preferably, the element has a circular profile although the element could have any shaped profile providing that the surface area of the element is sufficiently large so as not to affect the field in the vicinity of the ion trajectories. In especially preferred embodiments, the element is a planar element having a circular profile with a diameter of 75 mm.

Preferably the aperture is a circular aperture and the hollow elongated member has a circular cross-section of equal diameter to that of the aperture.

Preferably, the axis of the through channel is substantially perpendicular to the plane of the element.

In preferred embodiments, the aperture has a diameter equal to 1–30 mm, more preferably 2–6 mm and most preferably 4 mm. This is larger than a typical aperture in the known accelerating electrodes which normally measures 1–2 mm in diameter. This increase in the size of the aperture decreases contamination by material sputtered from the sample. Smaller apertures are likely to become clogged more quickly and therefore require more regular cleaning.

In preferred embodiments, the length of the through channel is 1 mm–30 mm, more preferably, 2–6 mm and most preferably 4 mm.

The hollow elongated, tube-like member provides a good extraction field shape whilst preventing a field penetration effect caused by the increase in aperture size.

Preferably, the element is made of stainless steel or aluminium but it could be made of any electrically conductive material.

In a second aspect, there is provided a TOF mass spectrometer having an ion source and a drift region, said ion source including:

a repelling plate to which a voltage can be applied to repel ions away from said plate; and at least one extraction lens according to the first aspect of the invention to which a voltage can be applied to accelerate ions towards said drift region.

In preferred embodiments, the mass spectrometer is a Maldi TOF instrument and the repelling plate is the sample plate, preferably made of stainless steel, on which the sample is deposited prior to ionisation. The mass spectrometer may also or alternatively be a reflectron spectrometer.

Preferably, the element is a planar element, and most preferably, a planar element of circular profile.

Preferably, there is only a single extraction lens. However, there may be a plurality of extraction lenses. Alternatively, there may be a single extraction lens and at least one accelerating electrode comprising a planar element having an aperture or grid situated between the extraction lens and the drift region.

In especially preferred embodiments, there is a ground plate separating the acceleration region i.e. the region after the extraction lens, from the drift region.

Preferably, the ground plate is a planar element having a grid or aperture. Preferably the distance from the ground plate to the extraction lens is 2.5–150 mm, more preferably 5–30 mm but most preferably 12 mm. In some embodiments, the ground plate could be the same shape as the extraction lens e.g. an element having an aperture, the aperture being surrounded by a protruding rim forming a hollow elongated tube-like member. Preferably, the ground plate is made of a metal such as stainless steel. In preferred embodiments, the aperture in the ground plate is slightly larger in diameter e.g. 1–2 mm than the aperture in the extraction lens.

In preferred embodiments, the axis of the through channel is perpendicular to the plane of the repelling plate and co-linear with the ion optical axis i.e. the line between the sample and a detector located at the limit of the drift region. Preferably the distance between the repelling plate and the extraction lens is between 1–30 mm, more preferably between 2 mm and 6 mm, most preferably 4 mm. This distance is known as the working distance.

In embodiments in which the extraction lens includes a hollow elongated member the working distance is taken as the distance between the repelling plate and the limit of the hollow elongated member.

Preferably, the aperture in the extraction lens is 0.5 to 2 times the working distance.

In preferred embodiments, in use, the electric field defined by the repelling plate and the extraction lens is pulsed to extract ions from the extraction region defined as the area between the repelling plate and the extraction lens. In order to achieve this pulsing effect, it is possible to pulse the voltage on the repelling plate or on the extraction lens whilst the other voltage is static, or both voltages may be pulsed.

In especially preferred embodiments, an electrostatic lens is placed at a specific distance after the ion source in the drift region. Preferably the electrostatic lens is positioned in the drift free region at a distance of 50–900 mm form the extraction lens, more preferably 100–300 mm from the extraction lens and most preferably at 170 mm from the extraction lens.

The ion trajectories i.e. the paths taken by the ions as they are repelled from the repelling plate, will have two distributions, spatial and angular. Preferably the spatial distribution is focussed by the extraction lens described above whilst the angular distribution is focussed by the electrostatic lens.

Preferably the electrostatic lens focuses the ion trajectories without destroying the focussing effect of the extraction lens. This can be achieved by ensuring that the extraction lens and the electrostatic lens are positioned sufficiently far apart.

Preferably the focusing of the extraction lens ensures that the ion trajectories are made to cross the ion optical axis (i.e. the line between the sample and the detector) at any point from in between the extraction and the electrostatic lens to a point just beyond (e.g. up to 100 mm beyond) the electrostatic lens. More preferably still the extraction lens ensures that the ion trajectories are made to cross the ion optical axis at the point between the extraction lens and the electrostatic lens. When the ion trajectories cross in between these points the focusing of the electrostatic lens has minimal or no detrimental effect on the focusing of the extraction lens.

It may be possible to swap the focusing functions of the lenses so that the extraction lens focuses the angular distribution while the electrostatic lens focuses the spatial distribution.

In a third aspect of the present invention there is provided a time of flight mass spectrometer having:

an ion source with a sample plate, a drift region, a light reflecting system including a support element having an aperture and at least one reflective element, and a light source for directing light onto the reflective element;

the spectrometer being configured such that, in use, ions from the ion source pass through the support element's aperture and light from the light source incident on the reflective element is reflected along a path towards the sample plate and towards the axis of the support element's aperture;

characterised in that the reflective element is releasably connected to and detachable from said support element As the at least one reflective element is releasably connected to and therefore detachable from the support element it may be easily cleaned and replaced. A separateable reflective element and support element also allows for easy and cheap manufacture. In particular it is possible to use "off the shelf" glass optical components as the reflective element(s), such components are cheap, of high quality and widely available.

Preferably the reflective element is made of glass.

Preferably, the support element is a planar element and most preferably a planar element of circular profile.

Preferably the sample plate is a repelling plate as described above in the second aspect of the invention.

In preferred embodiments the spectrometer is a Maldi TOF instrument. The spectrometer may be a linear TOF spectrometer or alternatively a reflectron spectrometer.

The reflective element may be a mirror but preferably is a prism. Preferably, the prism is a right angle equilateral prism. Preferably, the length of the side of the prism subtending the right angle is between 2–75 mm, more preferably between 4–25 mm but most preferably 6 mm.

The reflective element can be made of any suitable material. Normally this will be glass or metal. If the reflective element is mad e from an electrically insulating material, then it should preferably be given a conductive coating to prevent charging of its surface by stray ions.

Preferably, the reflecting properties of the reflective element are optimised for the wavelength of the light to be used by selecting an appropriate material from which to make or with which to coat the prism.

It is possible to have more than one reflective element arranged on the support element so that more than one light path is available at any one time. For example, four prisms spaced equally around the aperture will allow up to three lasers to be reflected at the same time as normal light e.g. for a telescope or camera.

In preferred embodiments, the aperture in the support element is surrounded by a protruding flange forming a hollow elongated member upstanding from the surface of the support element (which preferably although not necessarily is planar). In this case the prisms are located with one of their sides against the hollow elongated member. Preferably, the hollow elongated member is an earthed conducted tube that prevents any unwanted effects occurring in the event that the reflective elements become charged. In this case, the hollow elongated tube-like member shields the ion trajectories from the resulting field. More preferably still the support element itself is conductive and earthed. Preferably, the protruding tube is 3–75 mm in length, more preferably 6–25 mm and most preferably 12 mm in length.

Preferably, the aperture in the support element is circular and the protruding flange forming the hollow elongated member has a circular cross-section of equal diameter to that of the aperture.

Preferably the diameter of the aperture and the cross section of the tube-like member is from 2.5–75 mm, more preferably 5–25 mm in diameter and most preferably, 10 mm in diameter.

Preferably, light incident on the at least one reflective element hits the sample plate at the point that the axis of the aperture crosses the sample plate. In practice, the axis of the aperture is equivalent to the ion optical axis, i.e. a line between the point where ions are generated and detected (or in a reflectron spectrometer a line between the point where ions are generated and the point where ions enter the reflectron). More preferably, the path of light incident on the at least one reflective element crosses the ion optical axis at the repelling plate at a maximum angle of 30 degrees, more preferably at an angle of not more than 5 degrees and most preferably at an angle of 4–5 degrees.

Preferably, the light is from a laser source and the system is used to direct the laser beam into the extraction region. For example, in Maldi, the system can be used to reflect a laser pulse onto the sample plate to allow ionization. Alternatively or additionally, the system can be used to reflect laser light into the extraction region for reasons other than ionisation.

Alternatively or additionally, the system can be used to direct light into the extraction region to allow viewing of the sample e.g. by detection of scattered light with a telescope or camera.

In preferred embodiments, the mass spectrometer includes an ion source as described in the second aspect of this invention. However, any ion source can be used in combination with the light reflecting system provided that the apertures in any accelerating electrodes and or the ground plate located between the light reflecting system and the repelling sample plate are sufficiently large to allow light reflected from the prism to reach the repelling plate.

Typically, the diameter of the apertures in the electrodes/plates must be in the region of 2–24 mm and most preferably 4–8 mm.

In preferred embodiments, the light reflecting system is provided in the drift region of the mass spectrometer.

In especially preferred embodiments, the drift free region also includes an electrostatic lens either placed before or after the light reflecting system.

The extraction lens preferably functions to ensure that ion trajectories are made to cross the ion optical axis at any point from in between the extraction lens and the electrostatic lens to a point just beyond (e.g. up to 100 mm beyond) the electrostatic lens. The ion optical axis is the line between the sample and the detector in a linear TOF spectrometer or in the case of a reflectron spectrometer the line between the sample and the point of entry into the reflectron.

More preferably still the extraction lens functions to ensure that the ion trajectories are made to cross the ion optical axis at a point between the extraction lens and the electrostatic lens.

In the most preferred embodiment, the light reflecting system is used in conjunction with the ion source as described in the second aspect of this invention and an electrostatic lens as described above in the drift free region.

In a fourth aspect there is provided a light reflecting system for use in a TOF mass spectrometer according to the third aspect of the present invention.

Two preferred embodiments of the invention will now be described with reference to the accompanying Figures in which:

FIG. 1 is discussed in detail in the introductory portion of this description.

Figure 1:
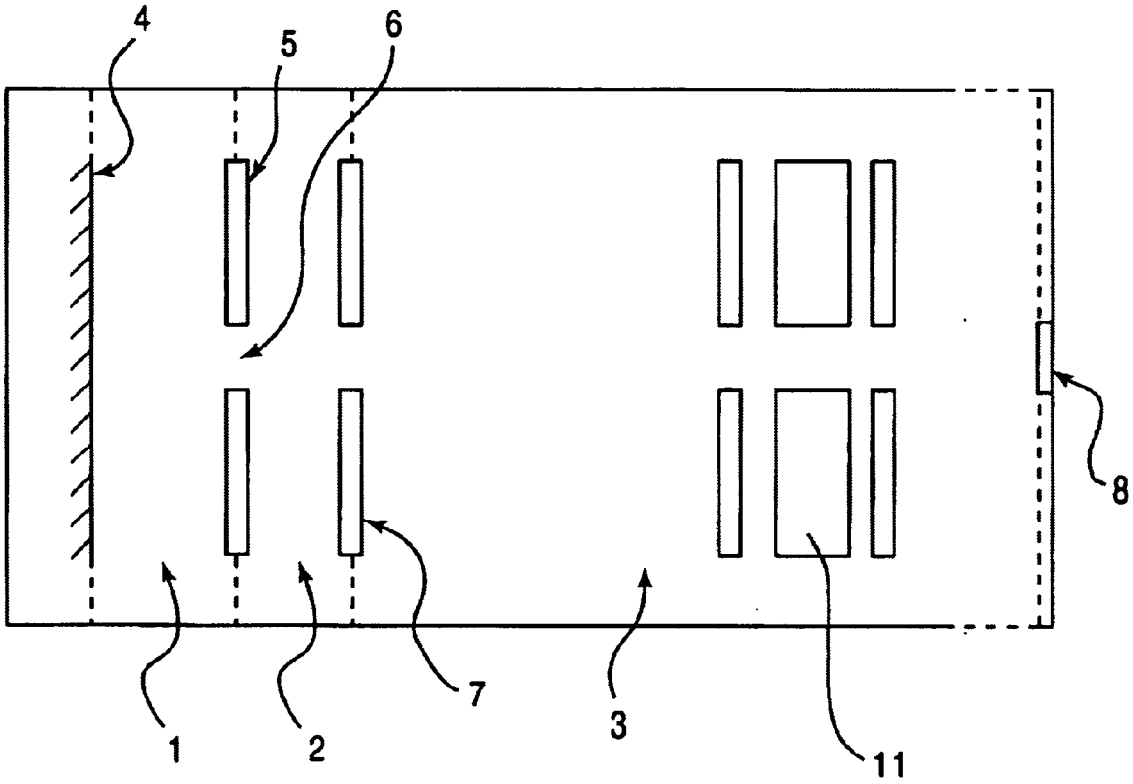
Fig. 1 PRIOR ART
FIG. 1 shows a schematic diagram of a known TOF mass spectrometer.
Figure 2:
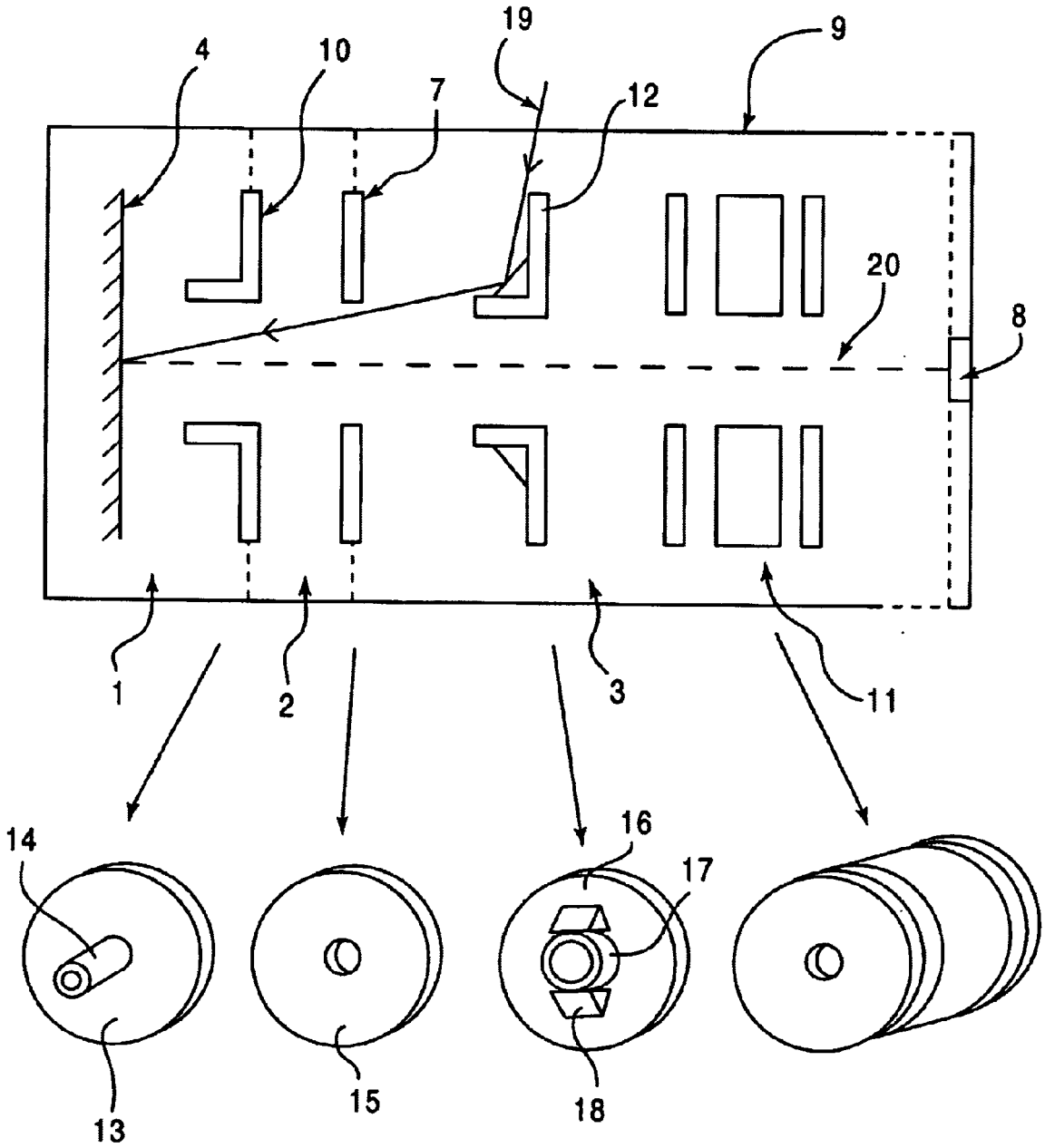
FIG. 2 shows a schematic diagram of a Maldi TOF mass spectrometer according to a preferred embodiment of the present invention.

FIG. 2 shows a Maldi TOF mass spectrometer having an extraction region, 1, an acceleration region, 2, and a drift region, 3. The extraction region is defined by a sample plate, 4, and an extraction lens, 10. The drift region 3 is between a ground plate 7/15 and the detector 8. The sample plate, 4, is a planar element on which the sample is located. In use, the sample is desorbed from the surface of the sample plate using a laser. After desorption, a repelling voltage of 20 kV is applied to the sample plate, 4, to repel the sample ions away from the sample plate towards the extraction lens, 10.

The extraction lens, 10, is positioned such that the distance between the sample plate, 4, and the extraction lens, 10, is 4 mm.

The extraction lens is formed of stainless steel and has a circular planar element, 13, with a central, circular aperture. Surrounding this aperture is a tube-like member, 14, that upstands from the planar surface. Preferably, the tube, 14, extends to a distance of 4 mm from the surface of the planar element, 13, such that there is a distance of 8 mm between the planar element,13, and the sample plate, 4.

Preferably, the diameter of the aperture and therefore also of the hollow tube is 4 mm. The hollow tube and aperture together form a through channel through which ions and light may pass from one side of the extraction lens to the other. The length of the through channel is equal to the diameter of the aperture. In alternative embodiments the length of the through channel may be greater than the diameter of the aperture. In yet another alternative embodiment the extraction lens may be provided without an upstanding tube-like member, but instead take the form of a thick circular planar element having a central circular aperture extending through the element and providing the through channel and in this case the axial width of the circular element must be sufficient that the aperture has a depth at least equal to its diameter.

Initially to ensure that there is no extraction, the extraction lens is preferably maintained at a voltage equal to that on the repelling plate. To extract the ions, the voltage on the extraction lens may be pulsed such that the voltage on the lens changes by 2–3 KV.

In practice, a time delay e.g. 100 ns to 2 $\mu$s is preferably allowed between applying a voltage to both the sample plate, 4, and the extraction lens, 10, and applying a change in voltage to the extraction lens, 10, such that the time delay between ion formation and acceleration reduces aberrations due to the kinetic energy spread of the ions. This is called delayed extraction.

The ground plate is a circular, planar element, 15, having a central circular aperture. Preferably, the distance between the extraction lens and the ground plate is 12 mm. The ground plate is made of stainless steel and the diameter of the central aperture matches that of the extraction lens i.e. 4 mm. This ground plate is maintained at a ground potential. As the length of the extraction lens's through channel is at least equal to the diameter of its aperture there is little or no field leakage through the aperture, despite the fact that the ground plate is maintained at ground potential while the region between the sample plate 4 and extraction lens 10 is typically maintained at a negative or positive potential (depending upon the polarity of the ions to be repelled).

The drift free region includes a light reflecting system which includes a circular planar element, 16, having a central aperture. The central aperture is surrounded by a protruding tube-like member, 17, that upstands from the surface by a distance of 12 mm. This tube-like member forms an earthed conductive tube which shields the prisms, 18, from unwanted effects. The planar element is formed of stainless steel.

There are two prisms,18, formed of glass but coated with a conductive material, located at either side of the tube-like member. The prisms are right angled prisms with the sides subtending the right angles being 6 mm long. The hypotenuse side extends from a point on the tube-like member to a point on the planar element.

One of the prisms is used to reflect a laser beam, 19, from outside of the ion source into the ion source via the aperture in the ground plate, the laser beam then striking the sample plate after passing through the aperture in the extraction lens. Thus, it can be seen that the apertures in the extraction lens and ground plate must be of a sufficiently large diameter so as not to impede progress of the laser beam.

The other prism is used to reflect light from the ion source through the ground plate and then into the extraction region through the extraction lens so that the sample can be viewed e.g. using a camera.

Preferably, the laser/light beam forms an angle of 4–5 degrees with the ion optical axis, 20.

Also, in the drift region is an electrostatic lens 11 which comprises two outer, circular, planer electrodes and a central, cylindrical electrode, all electrodes having a central, circular aperture of preferably approximately 10 mm diameter.

Figure 3:
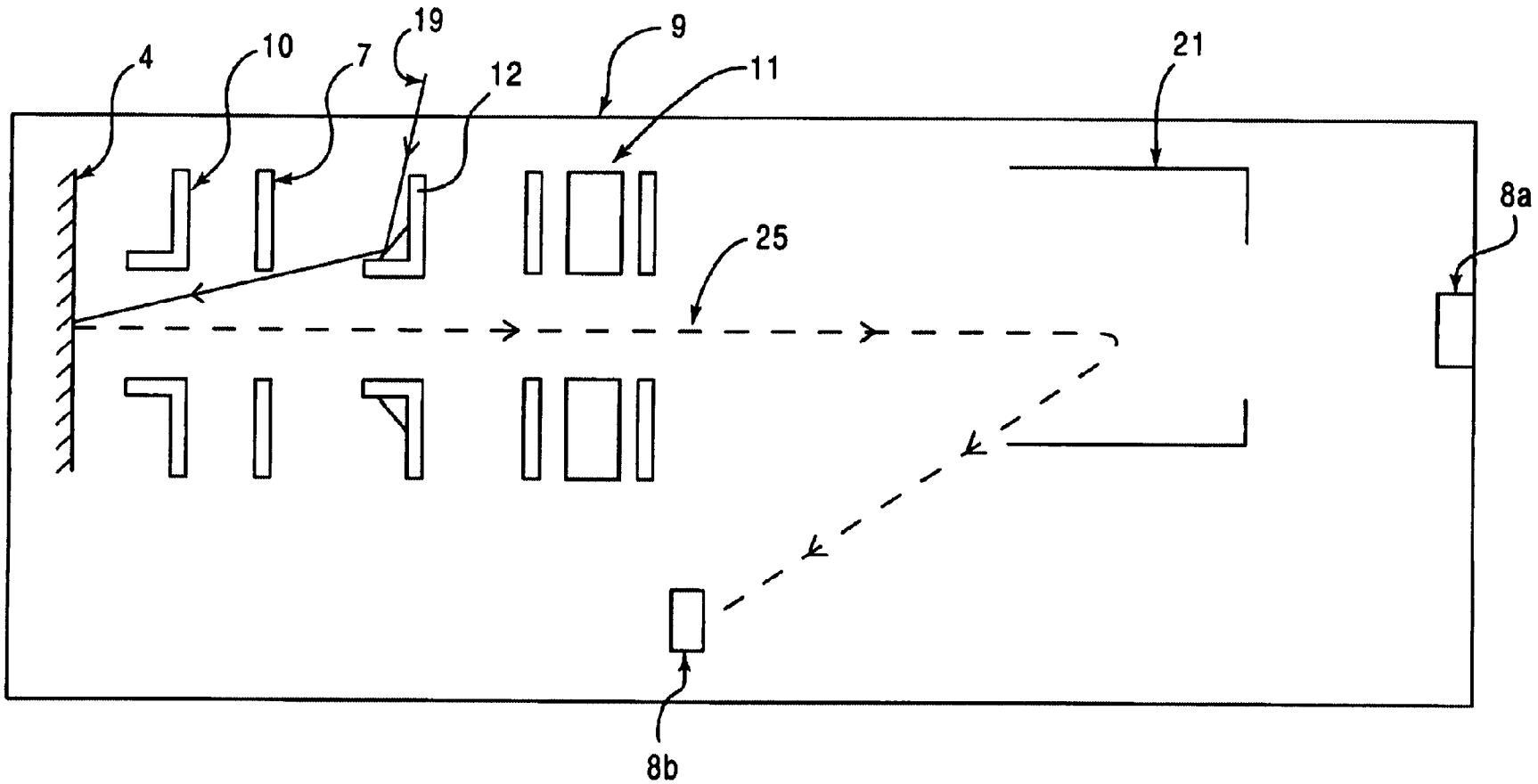
FIG. 3 shows a schematic diagram of a Maldi TOF reflectron mass spectrometer according to a preferred embodiment of the present invention.

FIG. 3 shows a Maldi TOF reflectron mass spectrometer which is similar to the linear mass spectrometer shown in FIG. 2 and in which like reference numerals refer to the same parts as in FIG. 2. In order to keep the description concise only the additional features (those not present in FIG. 2) will be described.

The spectrometer has a reflectron 21 positioned after the einsel lens 11 in the drift region of the spectrometer. The reflectron is made of several metal rings to which electric potentials may be applied in order to create a reflecting field within the reflectron. The field may be of a linear, quadratic or any other suitable form.

When the reflectron is "off" (i.e. no potentials are applied to its rings and so there is no reflecting field) ions from the ion source pass through the reflectron and strike the detector 8*a* at the end of the drift region. Therefore when the reflectron is "off" the spectrometer acts as a simple linear TOF spectrometer similar to the one shown in FIG. 2.

When the reflectron 21 is turned on by applying electric potentials to its rings a reflecting electric field is established in the reflectron and ions from the ion source entering the reflectron are reflected back at an angle to the ion source so that they strike the detector 8*b*. The path of the ions when the reflectron is on is generally indicated by the dashed line 25. The more energetic ions will penetrate deeper into the reflectron 4 being reflected, thus extending their time of flight, and this has the effect of improving the mass resolution of the spectrometer.

Elsewhere in the description reference has been made to the ion optical axis when discussing the path of light 19 reflected onto the sample plate, and the focusing of ion trajectories by the extraction lens 10 and the ions of lens 11. In this context the ion optical axis of the reflectron spectrometer can be taken to be the line between the sample and entry of ions into the reflectron (i.e. the path of the line 25 between the sample plate 4 and the reflectron 21).

The other illustrated components of the reflectron mass spectrometer are the same as those described in FIG. 2.

The above embodiments are given by way of example only and variations will be apparent to those skilled in the art.

What is claimed is:

1. A time of flight mass spectrometer having:

an ion source with a sample plate, a drift region, a light reflecting system including a support element having an aperture and at least one reflective element, and a light source for directing light onto the reflective element;

the spectrometer being configured such that, in use, ions from the ion source pass through the support element's aperture and light from the light source incident on the reflective element is reflected along a path towards the sample plate and towards the axis of the support element's aperture;

and characterized in that the reflective element is releasably connected to and detachable from said support element.

2. A time of flight mass spectrometer according to claim 1 wherein the support element is a planar element.

3. A time of flight mass spectrometer according to claim 1 wherein the reflective element is a prism.

4. A time of flight mass spectrometer according to claim 1 wherein the reflective element is made of glass.

5. A time of flight mass spectrometer according to claim 1 wherein the reflective element is formed of a conductive material or coated with a conductive material.

6. A time of flight mass spectrometer according to claim 1 wherein said support element has a plurality of reflective elements.

7. A time of flight mass spectrometer according to claim 1 wherein the aperture in the support element is surrounded by a protruding flange forming a hollow elongated member upstanding from the surface of the support element.

8. A time of flight mass spectrometer according to claim 7 wherein the reflective element or elements have one of their sides in contact with and supported by the hollow elongated member.

9. A time of flight mass spectrometer according to claim 8, wherein the hollow elongated member is an earthed conductive tube.

10. A time of flight mass spectrometer according to claim 1 wherein the support member is conductive and earthed.

11. A time of flight mass spectrometer according to claim 1 wherein the light reflecting system is configured such that light incident on the at least one reflective element hits the sample plate at the point at which the axis of the aperture crosses the sample plate.

12. A time of flight mass spectrometer according to claim 11 wherein the path of light incident on the reflective element crosses the axis of the aperture at the repelling plate at an angle of not more than 30 degrees.

13. A time of flight mass spectrometer according to claim 12 wherein the path of light incident on the reflective element crosses the axis of the aperture at the repelling plate at an angle of 4–5 degrees.

14. A time of flight mass spectrometer according to claim 1, wherein the light source is a laser.

15. A time of flight mass spectrometer according to claim 1, wherein the light source is for directing light onto a sample on the sample plate, via the reflecting element, so that the sample can be viewed by detection of scattered light.

16. A time of flight mass spectrometer according to claim 1 further comprising an ion source having an extraction lens, said extraction lens including an element having an aperture, said aperture extending through the element so as to form a through channel, such that, in use, ions may pass from one side of the element to the opposite side of the element by passing through said through channel;

characterized in that said through channel has a length equal to or greater than 8/10 of the diameter of said aperture.

17. A time of flight mass spectrometer according to claim 1 wherein the reflecting system is located in the drift region of the mass spectrometer.

18. A time of flight mass spectrometer according to claim 1, wherein the spectrometer further includes an electrostatic lens located in the drift region.

19. A time of flight mass spectrometer according to claim 17 wherein the electrostatic lens is located between the sample plate and the reflecting system.

20. A time of flight mass spectrometer according to claim 19 wherein the reflecting system is located between the sample plate and the electrostatic lens.

21. A light reflecting system for use in a TOF mass spectrometer according to claim 1, the light reflecting system including a support element and at least one reflective element releasably connected to and detachable from said support element.

22. A time of flight mass spectrometer having:

an ion source with a sample plate, a drift region, a light reflecting system including a support element having an aperture and at least one reflective element, and a light source for directing light onto the reflective element;

the spectrometer being configured such that, in use, ions from the ion source pass through the support element's aperture and light from the light source incident on the reflective element is reflected along a path towards the sample plate and towards the axis of the support element's aperture;

and characterized in that the reflective element is releasably connected to and detachable from said support element, wherein the reflective element is a prism formed of a conductive material or coated with a conductive material, wherein said support element has a plurality of reflective elements.

* * * * *